United States Patent [19]

Newman

[11] Patent Number: 5,054,303

[45] Date of Patent: Oct. 8, 1991

[54] METHOD OF EXTRUSION, AND EXTRUSION PRESS

[75] Inventor: Michael J. Newman, Gloucester, Great Britain

[73] Assignee: Indalex Limited, London, Great Britain

[21] Appl. No.: 520,220

[22] Filed: May 8, 1990

[30] Foreign Application Priority Data

May 10, 1989 [GB] United Kingdom ..... 8910747

[51] Int. Cl.[5] ..... B21C 26/00

[52] U.S. Cl. ..... 72/38; 72/273

[58] Field of Search ..... 72/38, 272, 273, 253.1

[56] References Cited

U.S. PATENT DOCUMENTS

| | | | |
|---|---|---|---|
| 2,904,830 | 9/1959 | Mulrooney, Jr. | 72/273 |
| 3,303,684 | 2/1967 | Starr et al. | 72/273 |
| 4,117,703 | 10/1978 | Takahashi et al. | 72/38 |
| 4,128,371 | 12/1978 | Kopp | 72/272 |
| 4,550,584 | 11/1985 | Degen | 72/273 |
| 4,714,423 | 12/1987 | Hattori et al. | 72/273 |
| 4,862,721 | 9/1989 | De Rush | 72/38 |

FOREIGN PATENT DOCUMENTS

| | | | |
|---|---|---|---|
| 1032206 | 6/1958 | Fed. Rep. of Germany | 72/273 |
| 2298379 | 8/1976 | France | 72/38 |
| 954126 | 4/1964 | United Kingdom | 72/273 |

*Primary Examiner*—Robert L. Spruill

*Attorney, Agent, or Firm*—Fleit, Jacobson, Cohn, Price, Holman & Stern

[57] ABSTRACT

In an extrusion press the void space between a pressure pad (4), a billet container (5), an extrusion die (6) and the billet (12) to be extruded is evacuated by suction through the pressure pad (4) and a hollow extrusion stem (3) before the commencement of extrusion. The extrusion ram (2) is hollow and contains a vacuum reservoir (7) connected to the hollow stem by a vacuum line (8) and valve (9). The vacuum line may have a compressed air line (10) and valve (11) connected to it.

10 Claims, 3 Drawing Sheets

METHOD OF EXTRUSION, AND EXTRUSION PRESS

BACKGROUND OF THE INVENTION

This invention relates to a method of extrusion, and to an improved extrusion press, to make the extrusion process more efficient and less wasteful of the material being extruded.

Although the present invention will be particularly described with reference to thee extrusion process as applied to aluminum alloys, the invention can be applied to other materials, which are pressure-extrudable.

An extrusion press is a machine that is designed to apply a known and controlled directional force, of known magnitude, against a known orifice via a quantity of aluminum alloy physically contained. The aluminum alloy is contained during the application of the applied force by a component forming part of the machine and known as the container.

The purpose of the container is to allow the force applied to the aluminum alloy contained within the internal dimensions or bore of the container to be converted into linear movement in the direction of the applied force through a component containing one or more precision orifices or dies constituting a die plate.

During the time that the aluminum alloy is subjected to linear movement and pressure the container is physically clamped to the die plate.

An extrusion die plate is a means of providing physical resistance to the linear movement of the contained aluminum alloy in order to allow the aluminum alloy to be shaped by the detailed geometry of the orifice. The extrusion die plate is manufactured with one or more precision orifices designed to allow the aluminum alloy that passes through the orifice or orifices to assume the required product shape.

The temperature of the aluminum alloy is raised to a known value prior to the application of the applied force.

The action of applying sufficient force to an aluminum alloy under these conditions results in the aluminum alloy being physically forced through the orifice, to produce a product of cross-section conforming to the shape of the orifice.

The method of generating the directional force, known as the extrusion pressure, is in principle that of a hydraulic ram and cylinder.

The extrusion pressure generated by the principal or main ram of the extrusion press machine is transmitted to the aluminum alloy contained in the container in a linear manner by means of a steel rod attached to the main ram via the ram crosshead and known as the extrusion stem.

A pressure pad is employed between the extrusion stem and the contained aluminum alloy. The pressure pad is designed to transmit the extrusion pressure from the extrusion stem to the contained aluminum alloy while permitting an aluminum alloy film of approximately 0.4 mm thick to be left in the container bore after the pressure pad has passed through the container under extrusion pressure. The consolidated aluminum remaining in the container after extrusion is known as the "discard".

The process of preparing an extrusion press to extrude a quantity of aluminum alloy often results in entrapping unwanted air in the cavities Within the container prior to the aluminum being subjected to the extrusion pressures.

If the entrapped air is pressurized by the extrusion process the results can be seen as severe damage to the finish of the extruded product, in the form of blistering, often accompanied by audible sound of the gases upon release to the atmosphere after passing through the die orifice.

The sequence of events relating to the physical movements of an extrusion press to perform the function of extruding hot aluminum alloy through an extrusion die can be broken down into specific stages known as press cycles.

A standard press cycle for the extrusion process in order to eliminate the problem of entrapped air is a cycle called the de-gas or "burp" cycle.

The de-gas cycle requires the aluminum alloy to be consolidated in the container at approximately half of the required extrusion pressure. The de-gas cycle then decompresses the components that are normally under extrusion or clamping pressure as in the case of the main ram, container and die plate.

The components are physically moved to break the seal around the area of the extrusion die to permit pressurized gases to escape. The de-gas cycle is then completed by re-initiating the container "close and seal" cycle as well as returning the main ram to its previous extrusion condition.

It has already been proposed, in UK Patent Specification No. GB-A-1,462,163, to remove air from the void volume within a billet container by applying a source of vacuum to an opening in the sidewall of the container. However, this method of evacuation will tend to draw air past the ram and will not work in evacuating the void space until the ram has consolidated the billet, at which point the opening will have been closed off by the ram.

BRIEF SUMMARY OF THE INVENTION

The present invention accordingly aims to overcome the problems described above and to provide an improved and more efficient extrusion press and extrusion process.

In one aspect the present invention provides a method of extrusion wherein the void volume between a pressure pad, a billet to be extruded, and the extrusion face of a die, within the billet container, is substantially evacuated by suction through the pressure pad and a hollow extrusion stem before extrusion is commenced.

Preferably this volume is substantially evacuated by connection to a source of vacuum via a vacuum reservoir capable of being evacuated to the minimum operational pressure within the time of a press-cycle; which reservoir is preferably contained within the main ram of the extrusion press and communicates via a hollow extrusion stem and the pressure pad with the void volume.

The reservoir may be suitably connected to the volume via an on/off vacuum valve and a vacuum line.

Preferably an air pressure line and valve is connected into the vacuum line in order to purge the volume with compressed air during or after extrusion.

The hollow vacuum reservoir within the extrusion ram may be suitably directly connected to a vacuum pump, as a source of vacuum.

In a second aspect the invention provides an extrusion press having a ram, a hollow extrusion stem, a pressure pad, a billet container and an extrusion die.

sealable to said container, wherein a vacuum reservoir is connected via a first vacuum line to a vacuum pump and via a second vacuum line and the hollow stem and the pressure pad to a volume defined between the pressure pad, the container, a billet being extruded and the extrusion face of the die.

The reservoir is preferably contained within the hollow ram.

Preferably, in this aspect, the vacuum line is connected, via an on/off valve, to a source of compressed air which may be used to purge the void volume defined above.

The pressure pad may be suitably of variable cross-section and expands to near fill the cross-section of the container. The pressure pad as a whole is usually generally bell-shaped.

The advantages of extrusion press operation according to this invention can be summarized as follows:

1. The gases can be partially removed prior to the aluminum being consolidated in the container without interrupting the normal loading extrusion cycle and so reduce the amount of time between production cycles of the extrusion press.

2. The action of removing the gases is specifically directed at the volume between the pressure pad and the extrusion die face within the confines of the container bore (that volume not occupied by the mass of the aluminum alloy to be extruded) and known as the normal atmospheric air gap. Due to the fact that the pressure pad as well as container bore and sealed extrusion die form a hermetically sealed pressure vessel, the action of removing the gases is possible due to the fact that the aluminum alloy has not been consolidated and the unoccupied volume around the aluminum alloy billet will be influenced by a change in the pressure as determined by the vacuum system.

The conventional gas removal cycle provides a means of decompressing the gases, but only at the extrusion die face as the aluminum alloy has been consolidated within the container bore, thus effectively sealing the gases trapped in the container between the consolidated aluminum alloy and the pressure pad.

The conventional gas removal cycle may leave gases under pressure in the area of the pressure pad with the possibility of damage to the pressure pad outside diameter forming the seal with the container as the pressurized gases are forced between the outside diameter of the pressure pad and the container bore under extrusion pressure.

3. A fixed pressure pad is designed to expand to a given diameter forming a seal with defined clearance in relation to the container wall or bore during the period it is subjected to extrusion pressure.

It thus follows that during the conventional de-gas cycle the pressure pad will expand twice, once when consolidating the aluminum alloy and then once again after retracting to expel the pressurized gases. The vacuum process reduces the number of times the pressure pad expands by 50% thus reducing the possibility of mechanical failure of the pressure pad through fatigue.

4. The elimination of the conventional de-gas cycle also reduces the number of operations involving decompression and reversal of the motions of the main ram and container components as well as the number of operations of the control gear during the extrusion cycle with subsequent reduction in component fatigue and wear.

A summary of the principle of operation, according to the invention, is described as follows:

The press cycle is standard for a conventional fixed pad and is initiated in automatic mode. The container closes and seals against the die force. The hot aluminum alloy billet to be extruded is brought up to the press center line by the press loaders and is pushed forward into the container by raised pressure points on the pressure pad, allowing the pressure pad bell to remain open.

The pressure pad and billet advance until the main ram position device signals that the pad main outside diameter is within the bore of the extrusion container.

At this point the billet has displaced the majority of the air at atmospheric pressure and the vacuum valve is initiated to equalize the pressure difference between that in the remaining container cavity around the billet and the vacuum stored in the reservoir contained in the extrusion press ram.

It should be noted that the vacuum can draw air from the front as well as the back of the billet during its vacuum cycle prior to billet compression.

The vacuum cycle cannot be used on the first billet of every die as air will be drawn through the die. This has the effect of unnecessarily lowering the vacuum potential as the die cavities are clear of aluminum and permit free air flow.

The pad continues to advance with full vacuum applied until the resistance of the billet against the die face closes the pad bell and the press indicates that the billet has consolidated.

At this point the vacuum is disconnected from the pad by the operation of the appropriate valve.

Normal extrusion takes place until a second main ram position device signals that the pressure pad is within a short distance of its final extrusion position determined by the commissioning engineer.

At this point the compressed air valve is initiated to pressurize the interior of the pad and place an opening pressure on the pad bell.

The press continues to extrude until the limit of extrusion position is reached.

During the conventional "strip or return" part of the cycle the main ram decompresses and starts to retract the pad away from the compressed discard aluminum on the die face.

The air pressure, applying force to the bell, holds the bell against the discard face as the pad retracts and so opens the bell positively and in a controlled manner. The application of air pressure to the pad interior prior to the pad being withdrawn from the discard results in a positive force being applied to the pressure bell, such as to initiate the separation of the bell from the body of the pad.

The pad continues to retract with a positive airflow venting through the gap between bell and pad body via the pad drillings, acting as a purge, until it reaches its fully back position.

BRIEF DESCRIPTION OF THE DRAWINGS

The invention will further be described, by way of example only, with reference to the accompanying drawings, which represent a sequence of operation according to the invention wherein.

DETAILED DESCRIPTION

Figure 1:
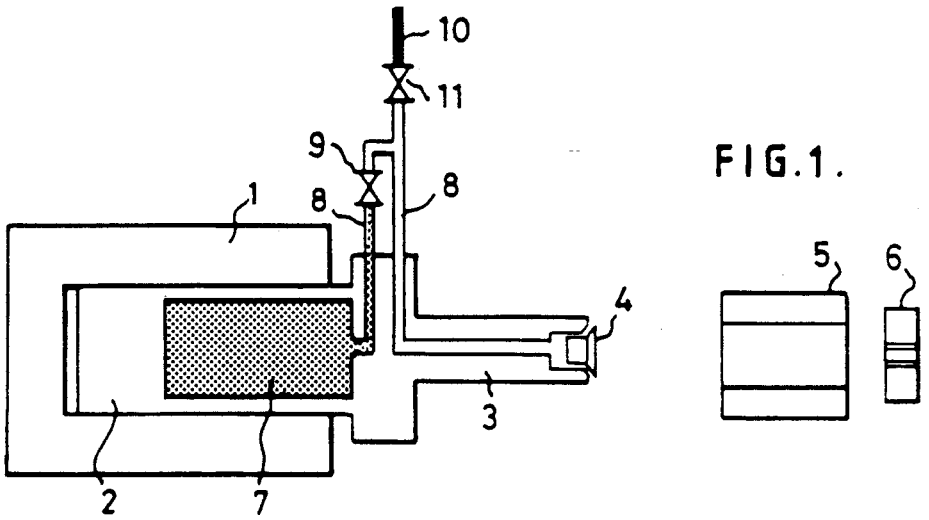
FIG. 1 is a schematic cross-sectional view which shows an extrusion press with a container and die disconnected.

In the drawings, a dotted area represents those parts where a vacuum exists and a solid area indicates those parts where compressed air is applied.

The drawings show an extrusion press 1 having a ram 2, a hollow extrusion stem 3, a generally bell-shaped pressure pad 4, a billet container 5 and an extrusion die 6 sealable to the container 5.

A vacuum reservoir 7 is contained within the hollow ram 2, and the reservoir 7 is connected via a first vacuum line (not shown) to a vacuum pump (also not shown) and via a second vacuum line 8 and the hollow stem 3 and the pressure pad 4 to a volume defined between the pressure pad, the container 5, a billet being extruded and the extrusion face of the die 6. The vacuum line 8 incorporates an on/off valve 9. The vacuum line 8 is further connected to a compressed air line 10 via an on/off valve 11, which source of compressed air may be used to purge the void volume thus defined.

The pressure pad 4 may be of variable cross-section and expands to near fill the cross-section of the container.

Figure 2:
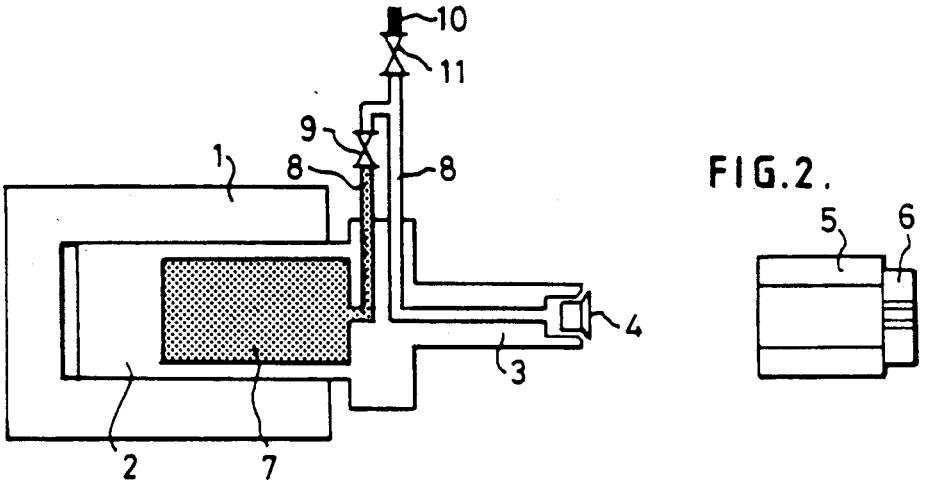
FIG. 2 is a view similar to FIG. 1 which shows the press with the container sealed to the die.

As will be apparent from the drawings, FIG. 1 shows the state of the extrusion press wherein the ram 2 is fully retracted and wherein the container 5 and the die 6 are disconnected, i.e. unsealed. In FIG. 2 the container is sealed to the die.

Figure 3:
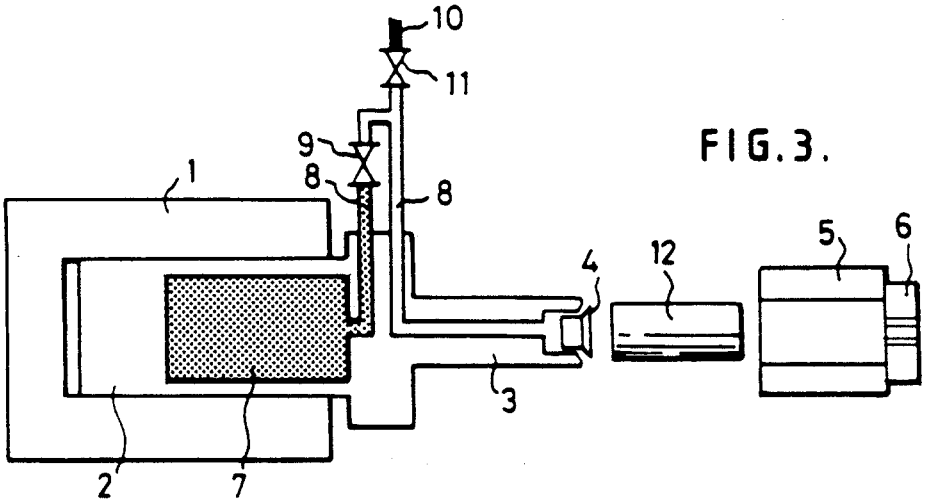
FIG. 3 is a view similar to FIGS. 1 and 2 which shows a billet inserted between a pressure pad and container.

FIG. 3 shows a billet 12 inserted between the pressure pad 4 and the container 5, with the ram 2 to be advanced forward to a position to load the billet into the container. The billet is brought up to the press center line by press loaders (not shown). As shown in each of FIGS. 1, 2 and 3, the valves 9 and 11 remain closed during these operations.

Figure 4:
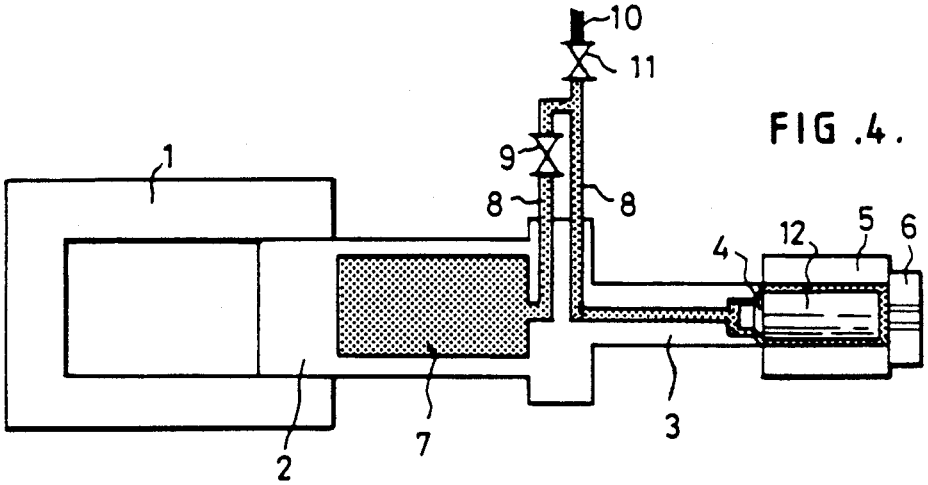
FIG. 4, similar to FIG. 1, shows the billet inserted within the container and vacuum applied to the volume between billet, pressure pad, die face and container.

FIG. 4 shows the billet 12 inserted within the container 5 and vacuum applied to the volume between the billet, the pressure pad 4, the face of the die 6 and the container 5, by opening the valve 9 and allowing the vacuum to be established through the line 8, whereby the vacuum reservoir 7 is effectively connected to the container 5. The ram 2 has advanced further forward to the position shown at which the vacuum is applied.

Figure 5:
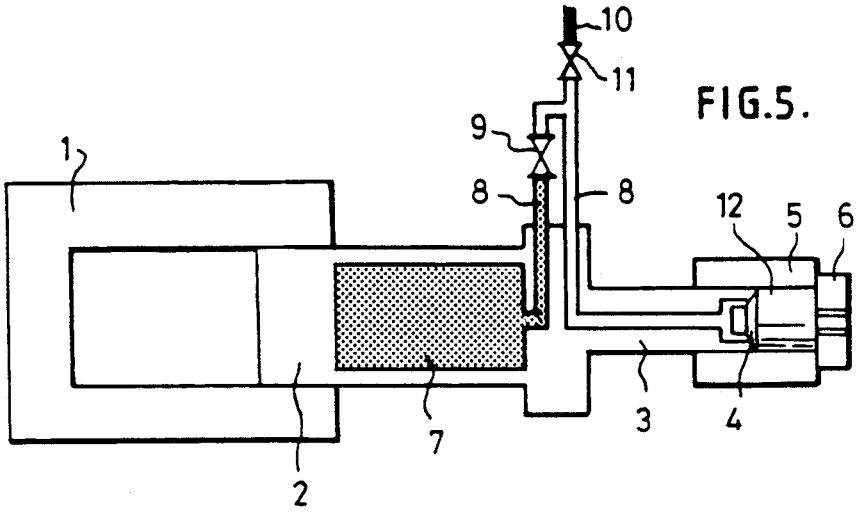
FIG. 5, similar to FIG. 1, shows the vacuum disconnected and a ram advancing to extrude the billet.

FIG. 5 shows the state where the vacuum reservoir has been disconnected by closing the valve 9 and wherein the ram 2 is advancing to extrude the billet, the ram being forward to a position to achieve normal extrusion.

Figure 6:
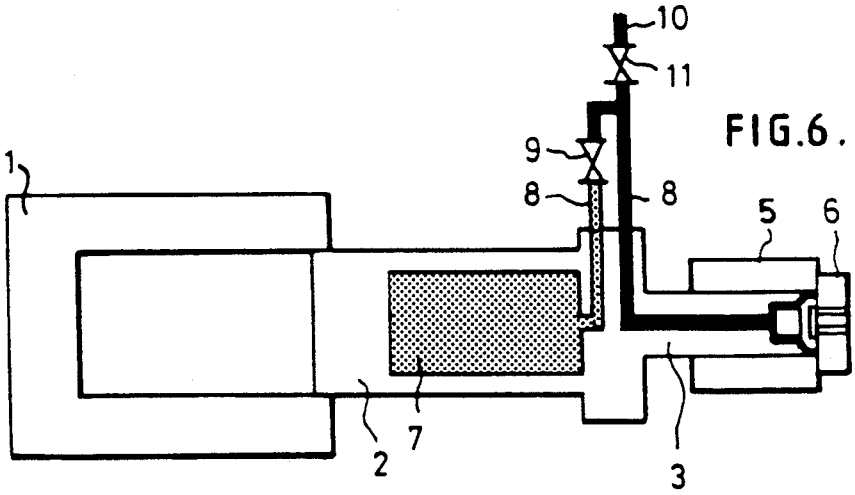
FIG. 6, similar to FIG. 1, shows the situation at the end of the extrusion phase, with compressed air connected to the pressure pad.

FIG. 6 shows the situation at the end of the extrusion phase, wherein the ram has advanced further forward and is approaching the limit of extrusion, and wherein the valve 11 has been opened to connect compressed air to the pressure pad 4.

Figure 7:
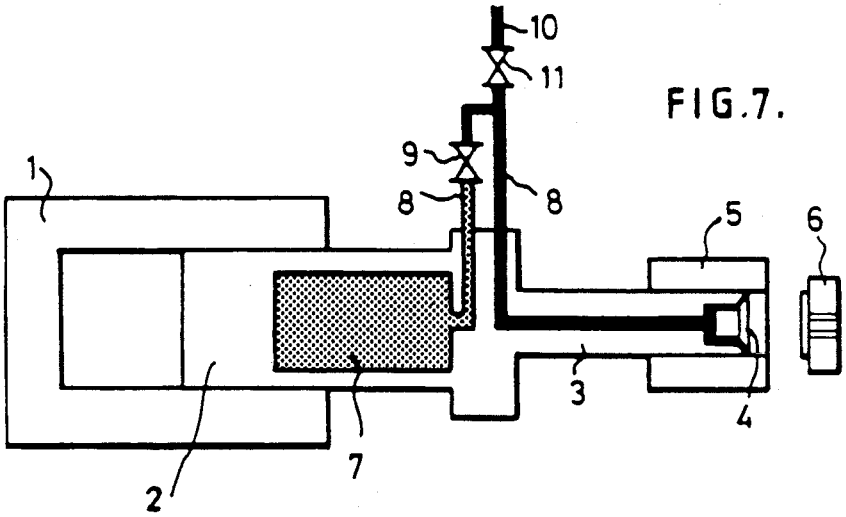
FIG. 7, similar to FIG. 1, shows the ram retracting, the extrusion die disconnected from the container and compressed air purging the container and pressure pad.
Figure 8:
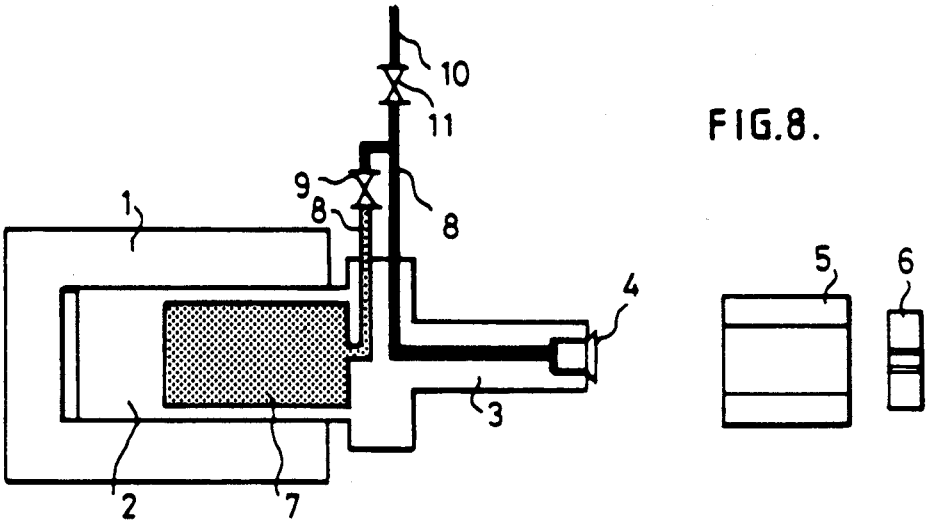
FIG. 8, similar to FIG. 1, shows the ram retracted with compressed air still purging the pressure pad.

FIG. 7 shows the ram 2 retracting, the extrusion die 6 disconnected from the container 5, and compressed air purging the container 5 and pressure pad 4. FIG. 8 shows the ram returned almost to its fully retracted position, with compressed air still purging the pressure pad 4.

Figure 9:
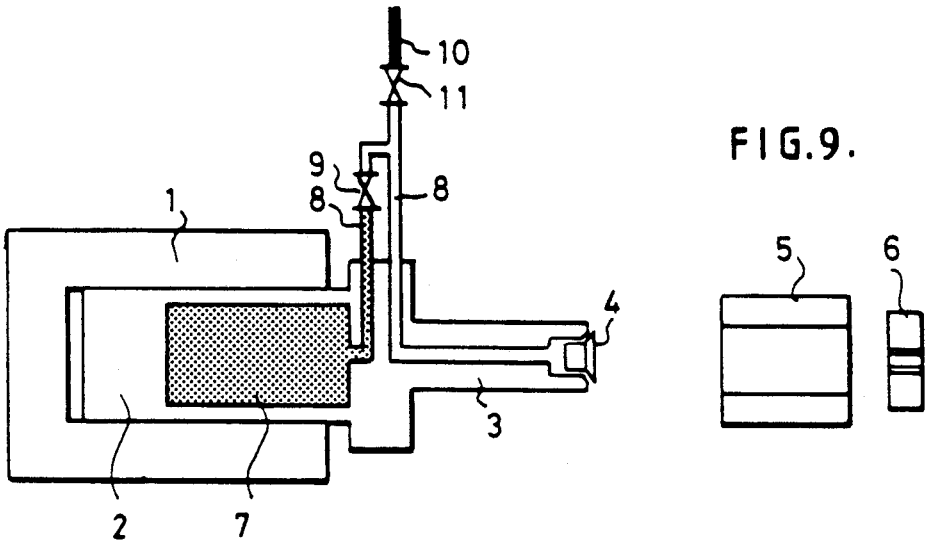
FIG. 9 shows a situation similar to that of FIG. 1 with the ram fully retracted and the vacuum and compressed air sources isolated from the pressure pad.

FIG. 9 shows a situation similar to FIG. 1, with the ram 2 fully retracted, and the valve 11 closed so that both the vacuum source and the compressed air source are isolated from the pressure pad 4.

I claim:

1. A method of extrusion in an extrusion press including an extrusion ram, a hollow extrusion stem extending from the ram, a pressure pad engageable with the stem and having a variable outer diameter, a billet container having a bore therein with an inlet and an outlet end for receiving the pressure pad and a billet urged by the stem and pressure pad, the bore being larger than the billet to provide a void space therebetween, and an extrusion die engageable with said billet container for receiving and extruding the billet from the bore of the container, the method comprising:

sealingly engaging the extrusion die with the billet container at the outlet end of the container bore;

inserting the billet into the bore through the inlet end thereof;

urging said billet in the bore toward the die by engaging the pressure pad against the billet and urging the stem against the pressure pad;

inserting the pressure pad into the bore;

evacuating the void space between the pressure pad, billet, container bore and sealed extrusion die by applying a vacuum thereto through the hollow stem and pressure pad thereby providing a hermetically-sealed pressure vessel;

expanding the outer diameter of the pressure pad to substantially the diameter of the bore; and commencing extrusion of the billet in the hermetically-sealed pressure vessel.

2. The method as claimed in claim 1 wherein said evacuating comprises connecting the hollow stem to a vacuum reservoir.

3. The method as claimed in claim 2 and further comprising:

providing the vacuum reservoir in a hollow cavity in the ram.

4. The method as claimed in claim 2 and further comprising:

applying the vacuum through a vacuum line connecting the hollow stem to the vacuum reservoir; and controlling the application of the vacuum by an on/-off valve in the vacuum line.

5. The method as claimed in claim 3 and further comprising:

applying the vacuum through a vacuum line connecting the hollow stem to the vacuum reservoir; and controlling he application of the vacuum by an on/off valve in the vacuum line.

6. The method as claimed in claim 4 and further comprising:

discontinuing the evacuation prior to commencing extrusion of the billet;

continuing extrusion of the billet; and applying compressed air through the hollow stem to the pressure pad at a predetermined position of the pressure pad in the container.

7. The method as claimed in claim 6 and further comprising:

applying the compressed air through a compressed air line connected to the vacuum line; and controlling the application of compressed air by a valve in the compressed air line.

8. An extrusion press comprising:

a ram;

an extrusion stem extending from said ram and having a hollow interior therein;

a billet container;

a billet receiving bore having inlet and outlet ends and a diameter larger than the diameter of a billet to be extruded to provide a void space in said container with said billet inserted therein;

a pressure pad engageable with said stem and hollow interior thereof and with said billet and insertable into said inlet of said bore for urging said billet into said inlet of said bore and through said bore, said pressure pad having a variable cross-section and being expandable to substantially the diameter of said bore;

an extrusion die sealingly engageable with said billet container adjacent said outlet end of said bore;

said extrusion die, billet, container bore and pressure pad forming a void volume comprising a hermetically sealed pressure vessel prior to commencement of extrusion;

a vacuum reservoir;

a vacuum pump;

a first vacuum line connecting said vacuum pump to said vacuum reservoir;

a second vacuum line connected to said vacuum reservoir and connectable to said hollow interior of said stem; and means for selectively connecting said second vacuum line to said hollow interior of said stem for evacuating said void volume prior to commencement of extrusion.

9. The extrusion press as claimed in claim 8 wherein:

said ram is hollow; and said vacuum reservoir is comprised of said hollow ram.

10. The extrusion press as claimed in claim 8 and further comprising:

a source of compressed air; and means for selectively connecting said source of compressed air to said second vacuum line for applying compressed air to said pressure pad at a predetermined position of said pressure pad in said container.

* * * * *